United States Patent [19]
Das et al.
[11] 4,381,064
[45] Apr. 26, 1983

[54] COATED SHEET MATERIAL AND CONTAINER THEREFROM

[75] Inventors: Narayan Das, Westmont; Surya K. Misra, Naperville, both of Ill.

[73] Assignee: National Can Corporation, Chicago, Ill.

[21] Appl. No.: 239,326

[22] Filed: Mar. 2, 1981

Related U.S. Application Data

[62] Division of Ser. No. 11,169, Feb. 12, 1979, Pat. No. 4,285,223.

[51] Int. Cl.[3] ..... B32B 5/00; B65D 90/04

[52] U.S. Cl. ..... 220/458; 148/31.5; 428/323; 428/341; 428/469; 428/689

[58] Field of Search ..... 428/323, 333, 341, 411, 428/458–463, 467, 469, 497, 499, 689; 148/31.5; 220/456, 458

[56] References Cited

U.S. PATENT DOCUMENTS

| | | | |
|---|---|---|---|
| 3,380,859 | 4/1968 | Dell et al. | 148/6.15 Z |
| 3,556,867 | 1/1971 | Glasson | 148/6.15 R |
| 3,577,753 | 5/1971 | Shah et al. | 75/41 |
| 3,670,543 | 6/1943 | Bott et al. | 72/349 |
| 3,684,588 | 8/1972 | Curran | 148/6.15 Z |
| 3,765,206 | 10/1973 | Shah et al. | 72/47 |
| 3,912,642 | 10/1975 | Sturwold et al. | 252/49.5 |
| 4,027,070 | 5/1977 | Asano et al. | 428/461 |
| 4,030,432 | 6/1977 | Miller et al. | 113/7 R |
| 4,032,678 | 6/1977 | Perfetti et al. | 427/388.2 |
| 4,165,242 | 8/1979 | Kelly et al. | 204/181 R |
| 4,185,485 | 1/1980 | Schick et al. | 252/42 |
| 4,235,947 | 11/1980 | Asano et al. | 72/42 |

FOREIGN PATENT DOCUMENTS

| | | | |
|---|---|---|---|
| WO79/00297 | 5/1979 | PCT Int'l Appl. . | |
| 1137449 | 12/1968 | United Kingdom | 148/6.15 R |

*Primary Examiner*—Michael L. Lewis
*Attorney, Agent, or Firm*—Robert A. Stenzel; Ralph R. Rath

[57] ABSTRACT

A stock material for producing seamless containers from a black plate base includes applying a layer of insoluble crystalline phosphate to each surface of the black plate and subsequently producing a thin film of organic lubricating material on the exposed surfaces of the phosphate layers so that a drawn and ironed container can be produced from a flat blank without the use of any additional lubricants during fabrication. The weight of the phosphate layer for each surface of the black plate base is preferably less than 100 milligrams per square foot, while the weight of lubricating film is on the order of 70 to 360 milligrams per square foot. In the preferred embodiment, the phosphate layer is preferably in the range of 20 to 35 milligrams per square foot, and the lubricant layer is on the order of 70 to 180 milligrams per square foot.

8 Claims, 2 Drawing Figures

COATED SHEET MATERIAL AND CONTAINER THEREFROM

REFERENCE TO RELATED APPLICATION

This application is a divisional application of Ser. No. 11,169, filed Feb. 12, 1979, now U.S. Pat. No. 4,285,223.

The present application relates to subject matter disclosed in pending U.S. application Ser. No. 851,856.

Description

TECHNICAL FIELD

The present invention relates generally to containers and more particularly to an improved stock material for making containers, a method for forming seamless drawn and ironed containers from the improved stock material and a container having significant cost and processing advantages.

The use of a two-piece container for packaging beer and/or carbonated beverage has become very popular in recent years and has virtually obsoleted the three-piece container. The two-piece container consists of a body that has an end wall unitary with and closing one end of a cylindrical side wall and an end which is seamed to the open end of the container body.

With the advent of the two-piece container, we understand they were initially formed from a soft aluminum stock material because of the relative ease in fabricability of the aluminum material from a flat disc to a finished container without the need of special coatings and/or special lubricants on the surface of the disc or blank before and during the drawing and ironing process.

For at least the past decade, manufacturers of the two-piece can as well as suppliers of steel have made numerous attempts to fabricate a drawn and ironed two-piece container from a black plate or low carbon steel material. After a decade of research and millions of dollars in investment, the only acceptable alternative that has been developed for the aluminum can is a tin plate container wherein the stock material is a black plate which has a thin layer of tin applied to each surface thereof.

Regardless of the stock material that is being utilized, can manufacturers are also attempting to eliminate the conventional emulsified oils that must now be used in drawing and ironing containers. When using water soluble emulsified oil, the oil or lubricant is normally mixed with the water coolant and is recirculated within the body maker and directed towards the outer surface of the cup that is being converted into a container as well as the ironing rings that reduce the wall thickness thereof. When using emulsified oils, the container body must subsequently be cleaned utilizing harsh chemicals and washing temperatures as high as 180 degrees F. to produce an acceptable surface that can subsequently be coated and/or decorated. Furthermore, some emulsified lubricants have a tendency to become toxic which presents a health hazard.

BACKGROUND PRIOR ART

Considerable effort has been directed towards producing a drawn and ironed container from a base material consisting of black plate. Further research has also been directed towards finding an acceptable substitute for the conventional water soluble emulsified oil that is presently being used for making drawn and ironed containers.

WIth respect to the research work done with black plate, U.S. Pat. No. 3,765,206 discloses a method of drawing and ironing a container utilizing a sheet of black plate steel having metal coatings, such as tin, with different lubricity on the opposed surfaces of the sheet. The patentee contemplates that the shallow cup can be transformed into a finished container utilizing a single ironing die cooperating with a punch. Such a process is not feasible from a commercial standpoint since it would require major deviation from present day commercial machinery that is utilized for producing drawn and ironed containers. Also, it is believed that the production rate utilizing such a process would be substantially less than the present production rate for producing drawn and ironed containers.

Another proposal for producing drawn and ironed containers from black plate is disclosed in U.S. Pat. No. 3,577,753. In this process, a thin metal, such as black plate, is cleaned to remove the oxide film and is then immersed in a lubricant film composed of a phosphate coating and an organic lubricant to produce a dry film lubricant on the surface of the metal. In order to produce containers from the metal with the dry film lubricant, the patentee proposes apparatus for producing drawn and ironed containers which maintains the temperature of the punch below 50 degrees F. to prevent thermal breakdown of the lubricant. Again, such a proposal is totally impractical from a commercial standpoint since it would require a production reduction down to a few cans a minute to be able to maintain the temperature of the punch at the desired level.

Another approach for producing drawn and ironed containers from black plate is suggested in U.S. Pat. No. 4,032,678 which contemplates supplying an organic thermosetting coating on the surface of the metal and partially curing the coating prior to drawing and ironing a container.

Another area that has received a substantial degree of attention in attempting to produce black plate drawn and ironed containers is to apply a phosphate coating to the surface of the black plate. In this connection, in the past decade, several chemical suppliers have attempted to incorporate phosphates in an organic solution into which the black plate was dipped and subsequently cured. Attempts were made to draw and iron this type of material but were unsuccessful in a multistage ironing process because most of the phosphate was removed by the first ironing ring in the body maker. Therefore, there is heavy metal pick up by the second and subsequent ironing rings because the metal surface is exposed.

Other manufacturers of chemicals have attempted to use phosphate in various forms as a lubricant for the drawing and ironing process. For example, some attempts have been made to utilize an emulsion oil mixed with a highly acidic phosphate and applying this mixture to the surface of a black plate. In addition, during the ironing process, a similar mixture was recirculated through the body maker to act as a further lubricant. During tests of this particular system, it was found that tungsten carbide ironing rings could not be utilized because of the metal pick-up from the stock material and, therefore, attempts were made to use specially designed silicon carbide ironing rings. While such specialized tooling did allow for the manufacture of some containers, the end product was far inferior to what is desired and acceptable in the industry at this time. Furthermore, the highly acidic solution resulted in corrosion of the tooling and also the machine components themselves.

Another phosphate lubricant which has been proposed is disclosed in U.S. Pat. No. 3,556,867. This process consists of applying a phosphate material to the metal surface and effecting a controlled reaction to form a phosphate coating which is at least partially unreacted with the metal surface. A fatty acid soap is then applied to the phosphate surface to effect a controlled reaction between the soap composition and the phosphate coating to form a soap coating which at least in part is reacted with the phosphate coating and the metal surface.

However, after extensive experimentation and costly research, all of these attempts have been dropped and at present the only commercial use of black plate for making drawn and ironed cans is to apply a thin layer of tin to each surface which acts as a lubricant during the drawing and ironing process.

In the drawing and ironing of black plate, one of the most difficult problems is to maintain sufficient lubricant between the die and the container during the ironing process. This is the area where actual deformation takes place, and when utilizing black plate, the plastic deformation of the black plate results in developing a large amount of heat energy. This large amount of heat energy has a tendency to cause a breakdown of most water soluble emulsified lubricants which results in galling of the formed metal surface or producing metal pickup on the die rings.

Furthermore, as the process continues at production rates, the retained heat in the dies increases and may reach a temperature of more than 300 degrees F. However, the instantaneous surface temperature of the metal may even be higher. At such a temperature, most emulsified lubricants tend to lose their lubricating capability. Also, when the emulsified oil or other lubricant is mixed with the water coolant, the cooling capability of the water is decreased.

This high temperature can also produce stripping problems. Stripping problems relate primarily to shrinkage of the container on the punch after the last ironing step and before stripping actually takes place which results in large frictional forces between the punch and the container. Stripping problems are most acute where the temperature gradient between the punch and the container is high, which is produced by the large frictional forces that are developed as the black plate wall is being reduced in thickness.

In this respect, numerous attempts have also been made to solve such problems. One proposal is disclosed in U.S. Pat. No. 3,670,543 which suggests roughening the surface of the black plate metal or low carbon steel to produce minute depressions in the surface so that the lubricant can be applied to the roughened surface and retained in these small depressions during the drawing and ironing operation.

Thus, while the prior art is replete with suggestions for solving the two basic problems encountered in attempting to draw and iron black plate metal, no acceptable commercial process has been developed which is economically feasible.

SUMMARY OF THE INVENTION

According to the present invention, a black plate surface is pretreated in a manner that the drawn and ironed container can be produced on commercial machinery, without any modification thereof and by utilizing only water as a coolant during the ironing process. It has been determined that conventional black plate or low carbon steel can be drawn and ironed without the use of any lubricant in the cooling system by initially contacting at least one surface of the black plate with an acidic phosphate solution to produce a water-insoluble layer of crystalline phosphate containing iron phosphate that is chemically bonded to the surface of the black plate. The crystalline nature of the phosphate layer provides an excellent carrier to thereafter apply thereon a non-reactive organic ester lubricant which can be retained thereon throughout the drawing and ironing process and provide sufficient lubricity, and which can be subsequently removed without undue difficulty.

It has been determined that the amount of phosphate and the amount of lubricant applied in discrete layers to the surface of the black plate is important to produce an acceptable container that is free of scratches and has a substantially uniform coating on the surface thereof to provide for rust protection. Any water soluble phosphate containing a cation that will exchange with iron in the black plate can be used as a source of phosphate anion ($PO_4^{-3}$) for forming the phosphate layer. In addition to iron phosphate, the phosphate layer can include a zinc phosphate and/or a manganese phosphate as well.

The thickness of the phosphate layer or coating is preferably on the order of 20 to 100 milligrams per square foot while the lubricant coating preferably is of the order of about 75 to about 375 milligrams per square foot. The specific organic lubricant that has been used successfully is a water-dispersible, oil-soluble organic ester lubricant that can be in a solid or a liquid form at ambient temperatures and can be applied in various ways as will be described later. The preferred group of organic ester lubricants is constituted by the esters derived from a monohydric or polyhydric alcohol and a fatty acid. Representative of such lubricants is a mixture of esters made from monomeric alcohols containing three to six hydroxyl groups and $C_{14}$ to $C_{20}$ fatty acids.

DESCRIPTION OF PREFERRED EMBODIMENTS

In preparing a black plate sheet or coil for the fabrication of seamless containers, the stock material is first contacted with an aqueous acidic phosphate solution and subsequently contacted with a lubricant to produce discrete layers of phosphate and lubricant within a critical range that will be described later.

To form the desired phosphate layer on black plate, in essence a conversion coating, phosphate ion ($PO_4^{-3}$) is caused to react with iron on the black plate surface so as to form a substantially uniform layer of a crystalline, water-insoluble iron phosphate, most likely primary ferrous and ferric phosphate, having a fine grain structure. Various other metal phosphates such as zinc phosphates, manganese phosphates, and the like, may also be present in the produced phosphate layer.

A convenient source of the phosphate ion for the present purposes is an aqueous acidic phosphate solution having a pH value of at least about 1 and preferably about 4 to about 6. The desired pH value in any given instance can be regulated by the addition of a suitable buffering agent, if needed. To form the foregoing phosphate solution any water-soluble phosphate containing a cation that will exchange with iron present on the black plate surface can be utilized. Solutions of this general type are known in the art and are commercially available. Such acidic phosphate solutions can be formulated using zinc phosphates, manganese phosphates, or other sources for the desired cations and anions, e.g., zinc oxide, phosphoric acid, manganese oxide, etc.

Initial phosphatization of black plate can be carried out in a number of ways. One of the methods that has been successfully utilized is the immersion technique wherein the stock material is immersed in the aqueous acidic phosphate solution for a predetermined time period and the bath is at a predetermined temperature. The resulting phosphatized stock material contains an iron phosphate coating, is then rinsed in water and dried. Another technique that can be utilized is to use a spray process in which a predetermined concentrate of the phosphate solution is applied to the surface of the black plate for a predetermined time and at a predetermined temperature. One of the most important aspects in the preparation of the black plate for drawing and ironing is to produce a substantially uniform phosphate coating of a predetermined thickness over the entire surface of the stock material.

It has been found that for optimum fabrication expediency, the thickness equivalent of the resulting, water insoluble crystalline phosphate layer should be on the order of 20 to 100 milligrams per square foot and preferably in the range of 20 to 35 milligrams per square foot.

Figure 1:
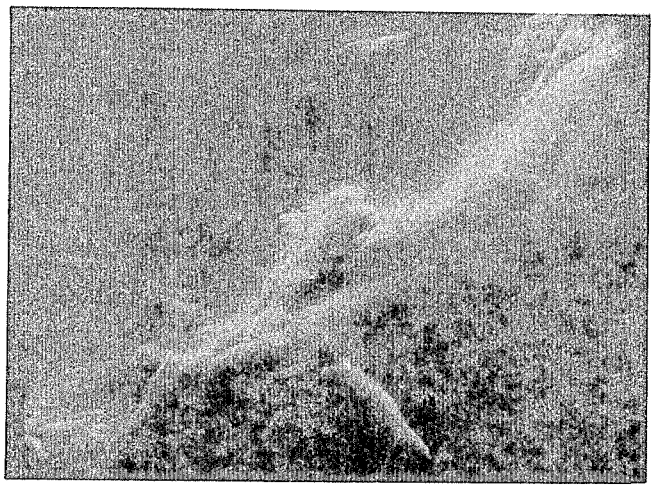
FIG. 1 is a photomicrograph showing the surface of the black plate before phosphatization.

Various tests were conducted to determine the characteristics of the phosphatized surface and the base surface which was treated with a phosphate solution. The black plate base material had a surface finish in the range of 20 to 60 microinches and exhibited a surface appearance shown in FIG. 1 at 5500X magnification. After phosphatization to produce a layer equivalent to about 35 milligrams per square foot, the surface appearance was as exhibited in FIG. 2 at 5500X magnification.

Figure 2:
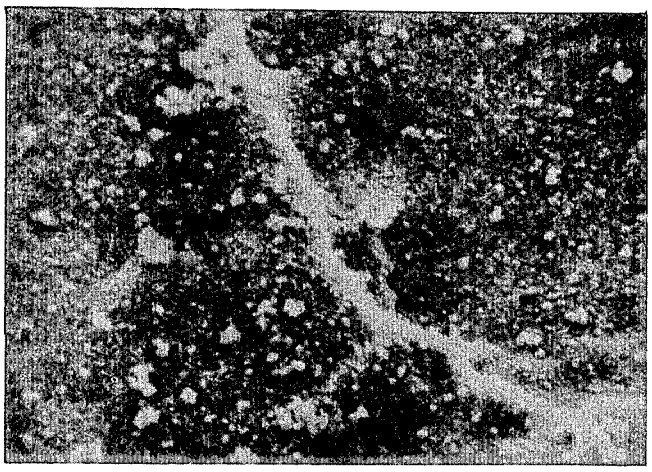
FIG. 2 is a photomicrograph showing the surface after a layer of phosphate has been applied to the black plate surface.

An inspection of FIG. 2 reveals that there is a uniform layer of phosphate over the entire surface of the black plate base. Measurements were made to determine the grain or particle size, and the result was that the majority of iron phosphate particles had a size in the range of about 500 angstroms to about 1500 angstroms, which is the preferred range for the majority of the particles. However, the overall effective range can be about 400 to 2500 angstroms for good results. Moreover, only a monolayer of phosphate need be present on the surface for black plate to be successfully drawn and ironed while still retaining a layer of phosphate on the finished container.

Rockwell hardness tests were also conducted to determine the effects the phosphate had on the hardness of the surface of the metal. No appreciable difference was noted in the hardness of the surface of the black plate metal before and after phosphatization.

One of the requirements for the applied lubricant, which determines the required thickness of the layer, is that the applied lubricant should provide the desired lubricity without breaking down during the ironing process. Also, the layer should not be so thick as to cause any undue buildup of the lubricant on the fabrication machinery. Moreover, the lubricant should be readily removable from the formed container by washing with water and a mild cleaner at relatively low temperatures. A further important requirement is that any residue thereof should not impart an undesirable flavor to the fabricated container contents.

The foregoing requirements are readily met by a non-reactive organic ester that is the reaction product of a $C_{12}$ to $C_{20}$ monobasic or polybasic carboxylic acid with a monohydric or polyhydric alcohol containing at least three carbon atoms. It is important for the purposes of the present invention that the organic ester does not react with the phosphate layer because the organic ester layer has to be removed after the ironing process has been completed. Of the various commercially available lubricants that have been tested, the most satisfactory results were achieved utilizing a lubricant that consisted of a mixture of esters made from monomeric alcohols containing three to six hydroxyl groups and $C_{14}$ to $C_{20}$ fatty acids, commercially available from Mobil Oil Company under the designation S-6661-003. Chemical analysis of this lubricant revealed that this lubricant had basic ingredients having the following physical properties: (1) acetone-soluble at cold temperature (40° F.) and excellent lubricity quality (about 26%), (2) acetone-soluble at ambient temperature and fair lubricity quality (about 50%), and (3) acetone insoluble and no lubricity quality (about 24%).

The organic ester lubricant coating can be applied neat, as an emulsion, or as a solution, utilizing a roller coating, a spray, or any other equivalent application means so as to deposit a thin layer of lubricant on each exposed surface of the respective phosphate layers. The thickness equivalent of the lubricant layer need be no more than about 425 milligrams of lubricant per square foot. While large amounts of lubricant may be used, no additional benefits are derived thereby. Preferably, the lubricant is applied in an amount of 75 to 300 milligrams per square foot. The lubricant can be in solid or liquid form at ambient temperature. However, for ease of application and handling, a lubricant in liquid form at ambient temperature is preferred.

Friction coefficients were evaluated for various black plate metals in an untreated condition and with the surfaces treated with a phosphate layer and a lubricant film as described above. A plain uncoated black plate disc was converted into a cup in a Minister cupper using a conventional emulsified lubricant during the cupping operation and the coefficient of friction was ascertained to be about 0.31. A disc having a uniform layer of phosphate on each surface and a surface film of an organic lubricant, as explained above, was converted to a cup in the same cupper using the same emulsified lubricant. The coefficent of friction was ascertained to be about 0.13. An additional cup was made from a tinplate disc having the characteristics of tinplate used in commercial production of drawn and ironed containers and the coefficient of friction was ascertained to be about 0.17.

Various experiments were conducted to optimize the preparation of a black plate surface for successfully drawing and ironing a container in a conventional body maker without the use of any additional lubricants in the drawing and ironing process. The drawing and ironing process that was utilized in all of the examples that will be discussed below consisted of a cupping machine that is capable of converting a circular blank into a cup having a flat bottom wall and a sidewall of essentially the same thickness as the initial stock material. The cup was then transferred to a body maker which consisted of a punch, a redraw ring and three ironing rings, as well as a domer. In drawing and ironing the cup, the cup was aligned with the punch and the punch forced the cup initially through the redraw ring wherein the diameter was reduced and the height was, therefore, increased. The cup was then passed successively through three ironing rings wherein three separate reductions of sidewall thickness of the cup were made and the height was progressively increased. At the end of the stroke for the punch, the punch and domer assembly cooperated to reform the end or bottom wall to a generally dome shaped configuration.

EXAMPLE 1

Initial phosphatization was carried out in the laboratory by an immersion technique, utilizing an aqueous phosphate solution which also included activating agents and crystal refinement additives. The material used to prepare the phosphate solution was a commerically available product in powder form obtained from Amchem Products and designated as Prep-N-Cote 302. A concentration of about 1.6 ounces of the powder per gallon of water was prepared and used at 75 degrees to 80 degrees F. with an immersion time of about 60 seconds. This procedure resulted in a crystalline iron phosphate layer having a thickness of about 23 milligrams per square foot.

Thirty strips of black plate were phosphatized, rinsed in a deionized water, and air dried. The phosphatized strips exhibited purple-gray color which were then coated with a lubricant layer on each side. A lubricant weight of 180 to 360 milligrams per square foot was applied to each surface of the phosphatized strips utilizing the commercially available Mobil S-6661-003 lubricant.

The lubricated strips were then blanked and cupped without utilizing any coolant or lubricant in a Minister cupper. No problems were encountered during the cupping operation, and good quality cups were obtained.

These cups were then fed into a Bliss body maker and drawn and ironed using water as a coolant without the addition of any lubricant thereto. The cans were readily stripped from the punch during the fabrication process utilizing knock-out pressures in the range of 30–35 PSI. An examination of the tooling revealed that there was no iron pick-up on the ironing rings, nor were there any scratches on the can surfaces. The can surfaces exhibited an excellent bright metallic luster superior to the luster of a conventional tinplate drawn and ironed can manufactured from the same tooling.

EXAMPLE 2

A plurality of black plate strips were immersed in a bath of Amchem Products Prep-N-Cote 302, at a concentration of 1.6 ounces per gallon of water and at a temperature of 75 degrees F. for a period of 60 seconds. The strips were then rinsed in deionized water and baked dry in an oven at 350 degrees F. for three minutes. The coating weight was analyzed and it was determined that the phosphate coating had an applied thickness of about 23 milligrams per square foot. A layer of Mobil S-6661-003 lubricant was then applied to each of the obtained phosphate surface to provide a film weight of 215 to 360 milligrams per square foot.

Two hundred cans were produced from the strips in the Minister cupper and Bliss body maker using water as a coolant. The finished cans exhibited bright, shiny surfaces with no scratching on the sidewall, and the containers were readily stripped from the punch utilizing conventional knock-out pressures.

EXAMPLE 3

Utilizing the same procedure as Example 2, a number of strips were phosphatized at an elevated temperature of 150 degrees F. while maintaining the other parameters the same as in Example 2, and it was determined that the coating weight was about 27 milligrams per square foot. A layer of Mobil S-6661-003 lubricant was then applied to each of the phosphate layers to provide a film weight of 215 to 360 milligrams per square foot.

The strips were then converted to finished containers and two hundred such containers were successfully prepared with no buildup of iron on the ironing rings. All of the finished containers exhibited the same bright, shiny surface with no scratching on the sidewalls as was true in Example 2.

EXAMPLE 4

A number of black plate strips were phosphatized using an aqueous zinc phosphate solution. The surfaces of the strips or blanks were initially cleaned in a solution consisting of water and a commercially available cleaner designated as Ridoline 78 available from Amchem Products, at a concentration of one ounce per gallon. The solution was maintained at a temperature of 150 degrees F. and the blanks were immersed for one minute.

The cleaned blanks were then immersed for 30 seconds in an aqueous acidic zinc phosphate solution (Granodine 46S, 2 percent by weight per gallon of water, purchased from Amchem Products). The treated blanks were then rinsed in deionized water and dried in an oven at 350 degrees F. for three minutes. The resulting phosphate coating weight was about 72 milligrams per square foot.

A film of Mobil S-6661-003 lubricant was then applied to each of the phosphate layers to provide a film weight of 215 to 360 milligrams per square foot.

These strips were then converted into cans and 200 such cans were successfully prepared with only a slight difficulty in stripping the finished containers from the punch. As in Examples 2 and 3, the finished containers exhibited bright, shiny surfaces with no scratching on the sidewalls.

Numerous additional tests were conducted for the strips of Examples 2, 3 and 4 to determine various characteristics thereof. The amount of phospate coating on the finished container was analyzed by cutting a four inch square disc from a container of each of the three variables and immersing this disc in a chromic acid solution to determine the final coating weight. The following results were found:

| Variables | Can Surface Coating |
|---|---|
| Example 2 | 7.2 milligrams per sq. ft. |
| Example 3 | 10.0 milligrams per sq. ft. |
| Example 4 | 12.0 milligrams per sq. ft. |

An analysis was also made to determine the amount of reduction of the phosphate coating at the various ironing stations during the conversion of the disc to a finished container. Utilizing a strip processed in accordance with Example 3 and utilizing a chromic acid solution, the following results were observed:

| Variables | Phosphate Coating Weight, mg/ft.$^2$ | Percent Cumulative Reduction In Coating Weight |
|---|---|---|
| Plate/Cups | 27 | 0 |
| Redraw Ring Only | 20.2 | 25 |
| Redraw + 1st Ring | 16.2 | 40 |
| Redraw + 1st + 2nd Ring | 12.6 | 53 |
| Final Can | 12 | 56 |

It should be noted that while there is a substantial reduction in coating weight, this is in fact not a loss of phosphate coating but merely a substantially proportionate distribution of the phosphate coating over the surface area of the sidewall as this area is increased during ironing.

The resultant phosphate coating on the side wall of the finished container is therefore less than 50 milligrams per square foot. Assuming a 70 percent reduction in wall thickness, a disc or blank having a phosphate layer of about 100 milligrams per square foot is converted to a finished container, the finished container would have a resultant coating layer of about 30 milligrams per square foot. Likewise, blanks having an initial phosphate coating of about 30 to 35 milligrams per square foot and converted into finished containers would have a resultant phosphate coating of about 6 to about 11 milligrams per square foot. In summary, for best results, the phosphate layer on the finished container should be less than 12 milligrams per square foot.

EXAMPLE 5

Additional black plate strips were phosphatized in a bath having a concentration of 1.5 ounces per gallon of Amchem Prep-N-Cote 302 at a temperature of 80 degrees F. for one minute. Analysis of these strips indicates that there was a uniform phosphate coating on both sides to a weight equivalent to about 20–25 milligrams per square foot. The phosphatized strips were then coated on both sides with a Mobil S6661-003 lubricant to produce a film weight equivalent to about 215 to 305 milligrams per square foot. The strips were then fabricated in a Minister press and Bliss body maker using water only as a coolant in the body maker and good quality containers were obtained with no pick-up on the tooling.

The cans were then cleaned in a Ridoline 632 alkaline cleaner (available from Amchem Products), rinsed in deionized water and baked in an oven at a temperature of about 365 degrees F. for about three minutes. One half of these containers was then wash-coated with a Celanese 1471JL coating which is a transparent organic protective coating available from Celanese Corporation. All containers were then decorated in a commerical decorating line utilized for decorating tin plate cans and evaluated for corrosion resistance and appearance. The result was that there was no significant difference in performance or appearance between both groups of cans. In addition, the cans of both groups were superior in appearance to cans made from standard tinplate and decorated in the same manner.

Adhesion tests were then made for the decorated cans, and it was observed that the adhesion for the black plate cans (with or without a wash-coat) was superior to the adhesion for comparable tin plate cans decorated in the same manner.

EXAMPLE 6

With the success of the experimental work in the laboratory, a plant run was conducted. A Weirton T-2 temper, 107 pound, silicon killed, dry black plate was cut into 6 inch by 26 inch strips. These strips were phosphatized in a pilot washer by spraying a concentration of 1.5 ounces of Amchem Prep-N-Cote 302 per gallon of water at a temperature of about 125 degrees F. for about 20 seconds. The strips were rinsed with tap water and finally with deionized water and were oven dried at about 375 degrees F. for about four minutes. Several coating weight measurements were made using a chromic acid dip technique and it was determined that the coating had a thickness equivalent to 25 to 35 mg./ft.$^2$.

The strips were then roll-coated with Mobil S6661-003 which was diluted with xylene to obtain a film weight equivalent to about 105 to 180 milligrams per square foot. The strips were then fabricated into 5000 cups in a Minister cupper in laboratory facilities without using any lubricant or water. Excellent quality cups were produced. These cups were stored at ambient conditions for about five weeks without any corrosion being noticeable at the end of the five week period.

Additional strips were coated and lubricated as described above and 500 additional cups were made a week prior to the plant run.

In the plant run, the normal emulsified oil lubricating system was replaced with a tap water system and the other water was heated to a temperature of 65–70 degrees F. The conventional push-rod and nose-piece were modified to increase the volume of air to assist stripping the finished containers from the punch.

After preliminary adjustment of the tooling and production parameters, the five week old as well as the one week old cups were converted to ironed cans, all of which were of excellent surface quality. The cans were produced at a rate of about 130 strokes per minute. The finished cans had an excellent, bright, abrasive free appearance and a uniform layer of phosphate was present on both can surfaces. It was also observed that even when some minor scratches appear on the container surface, these did not occur in subsequent containers as the process continued, indicating a potential increased tool life, i.e., self healing.

The cans were then cleaned in a commercial washer line, and good cleaning of the exterior surface was observed.

The stock material produced in accordance with the present invention is unique in that all of the materials necessary for producing a finished container are preapplied to the base material. Thus, only water is necessary in the body maker as a coolant and, since the water is not mixed with any lubricants, the cooling effect is increased. While only water is necessary to evoke satisfactory containers, in some instances a small amount of lubricant may be desirable in the water to act as a rust inhibitor for the tooling.

A very significant aspect of the invention is that containers can be produced at substantially less cost when compared to commercial containers produced from tin coated black plate. The end product is also superior to a tinplate container.

Conversion of the steel surface to a non-metallic phosphate surface permits the distribution and retention of the organic ester lubricant over the entire surface of the black plate during drawing and ironing while permitting ready removal during the cleaning cycle. The synergistic interaction between the phosphate coating and the organic ester lubricant results in retaining the lubricant on the surface throughout the ironing process, thereby minimizing the friction between the metal and the ironing rings. Since the lubricant remains on the phosphate surface throughout the ironing, virtually all of the phosphate layer that is originally applied to the blank sheet remains on the surface of the metal throughout the ironing process.

The end result is that the phosphate coating provides an excellent corrosion protection on the can surface so that the containers may be stored for a substantial period of time before they are finally decorated. The lubricant can readily be removed using water and a mild cleaner. Even if some lubricant of the above-described organic esters remains on the surface, it will not produce any adverse flavor to the contents. When the cans are coated and decorated, after the lubricant is removed, the phosphate coating enhances the adherence of the label coating and improves the appearance of the finished label.

What is claimed is:

1. A stock material suitable for use in making a drawn and ironed container comprising a black plate base having a phosphate layer on at least one surface thereof and chemically bonded to said surface, the grain size in said phosphate layer being in the range of about 400 to about 2500 angstroms, said phosphate layer having a thickness equivalent to about 20–100 milligrams per square foot, said phosphate layer being applied to both surfaces of said black plate base and said phosphate layers each having the aforesaid range of thicknesses and said phosphate layers being substantially equal in thickness, and a layer of an organic ester lubricant on each of said phosphate layers but unreacted therewith so that a drawn and ironed container can be formed from said stock material.

2. A stock material as defined in claim 1 in which the grain size in each of said phosphate layers is in the range of about 500 to 1500 angstroms and each layer is substantially a monolayer of phosphate.

3. A stock material suitable for use in making a drawn and ironed container comprising a black plate base having a phosphate layer on at least one surface thereof and chemically bonded to said surface, the grain size in said phosphate layer being in the range of about 400 to about 2500 angstroms, said phosphate layer having a thickness equivalent to about 20–100 milligrams per square foot, and a layer of an organic ester lubricant on the phosphate layer but unreacted therewith so that a drawn and ironed container can be formed from said stock material.

4. A stock material as defined in claim 3 in which the grain size in said phosphate layer is in the range of about 400–1500 angstroms and said layer is substantially a monolayer of phosphate.

5. A seamless drawn and ironed container consisting of a black plate base material having an integral layer of insoluble crystalline phosphate chemically bonded to an outside surface of the side wall thereof which produces a corrosion-resistant layer for said surface of said black plate base material, said layer being totally reacted and having a thickness equivalent to less than about 50 milligrams per square foot, the inside surface of said container having an integral layer of water insoluble crystalline phosphate chemically bonded thereto and totally reacted and having a thickness equivalent to less than about 50 milligrams per square foot, each layer of said phosphate having a grain size in the range of about 400 to about 2500 angstroms.

6. A seamless drawn and ironed container as defined in claim 5 in which the grain size is in the range of about 500 to about 1500 anstroms and each layer of phosphate is essentially a monolayer.

7. A seamless drawn and ironed container as defined in claim 6 in which said thickness equivalent of said phosphate layer on said inside and outside surfaces is less than 12 milligrams per square foot.

8. A seamless drawn and ironed container as defined in claim 7 in which the thickness of the respective layers of phosphate coating is substantially equal.

* * * * *